US009932956B2

(12) United States Patent
Hwang et al.

(10) Patent No.: US 9,932,956 B2
(45) Date of Patent: Apr. 3, 2018

(54) LASER IGNITION DEVICE

(71) Applicants: DENSO International America, Inc., Southfield, MI (US); DENSO CORPORATION, Kariya-shi, Aichi-ken (JP)

(72) Inventors: Jeongung Hwang, Northville, MI (US); Christopher Thomas, Oakland, MI (US); Nicholas C. Polcyn, Commerce, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 28 days.

(21) Appl. No.: 15/052,164

(22) Filed: Feb. 24, 2016

(65) Prior Publication Data

US 2017/0241395 A1 Aug. 24, 2017

(51) Int. Cl.
*F02P 23/04* (2006.01)
*F02B 5/02* (2006.01)

(52) U.S. Cl.
CPC ..... *F02P 23/04* (2013.01); *F02B 5/02* (2013.01)

(58) Field of Classification Search
CPC ..... F02P 23/04; F02P 9/007; F02P 7/073
See application file for complete search history.

(56) References Cited

U.S. PATENT DOCUMENTS 7,420,662 B2 * 9/2008 Yalin ..... F02D 35/022 356/317
7,770,552 B2 * 8/2010 Schultz ..... F02B 19/12 123/143 B
7,806,094 B2 * 10/2010 Gruber ..... F02M 57/06 123/143 B
8,701,612 B2 4/2014 Gruber
8,789,497 B2 7/2014 Weinrotter et al.
8,826,876 B2 * 9/2014 Gruber ..... F02P 23/04 123/143 B
8,833,323 B2 * 9/2014 Weyl ..... F02C 7/264 123/143 B
8,939,120 B1 * 1/2015 Meneguzzi ..... B30B 1/002 123/145 A
9,255,549 B1 * 2/2016 Brown ..... F02K 9/95
(Continued)

FOREIGN PATENT DOCUMENTS

JP 4415897 B2 2/2010
JP 2015001158 A 1/2015

*Primary Examiner* — Long T Tran
(74) *Attorney, Agent, or Firm* — Harness, Dickey & Pierce, P.L.C.

(57) ABSTRACT

A laser ignition device for an internal combustion engine can include a laser generator, a housing, and a window. The laser generator can emit a pulse of laser light. The housing can be coupled to the internal combustion engine. The housing can have a first end and a second end. The second end can be proximate to a combustion chamber of the internal combustion engine and can define an aperture through which the laser light is permitted to exit the housing into the combustion chamber. The window can be coupled to the second end of the housing and cover the aperture. The window can permit the laser light to pass through the window and into the combustion chamber. The window can have a rounded outer surface.

19 Claims, 4 Drawing Sheets

(56) References Cited

U.S. PATENT DOCUMENTS

| | | | | |
|---|---|---|---|---|
| 2005/0063646 | A1* | 3/2005 | Gupta | F02P 23/04<br>385/88 |
| 2006/0032471 | A1* | 2/2006 | Yalin | F02P 23/04<br>123/143 B |
| 2008/0035088 | A1* | 2/2008 | Klausner | F02P 23/04<br>123/143 B |
| 2008/0264371 | A1* | 10/2008 | Taido | F02P 15/00<br>123/143 B |
| 2011/0308489 | A1* | 12/2011 | Herden | F02B 19/12<br>123/143 B |
| 2012/0037108 | A1* | 2/2012 | Herden | F02B 19/12<br>123/143 B |
| 2013/0112164 | A1 | 5/2013 | Morishima et al. | |
| 2014/0109855 | A1 | 4/2014 | Gruber | |
| 2014/0290613 | A1* | 10/2014 | Gruber | F01P 1/06<br>123/143 B |

* cited by examiner

FIG - 3
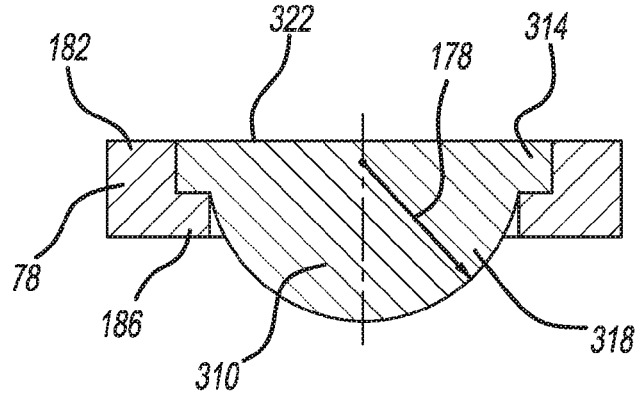
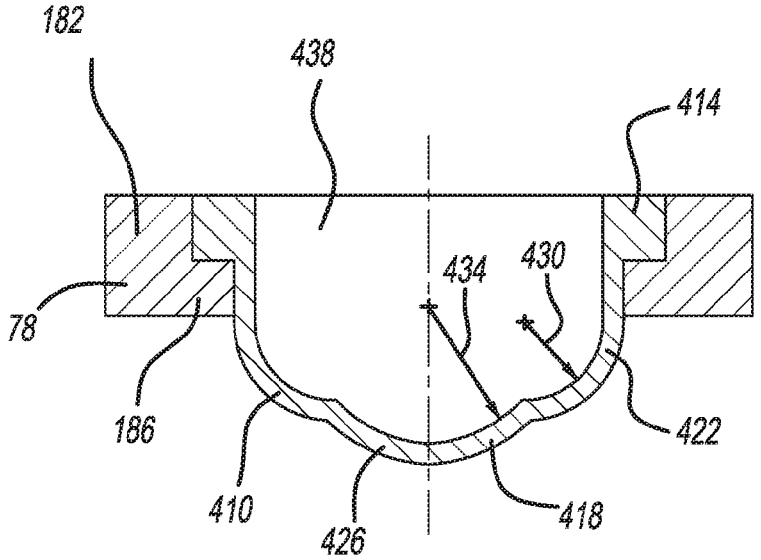
FIG - 4
FIG - 5
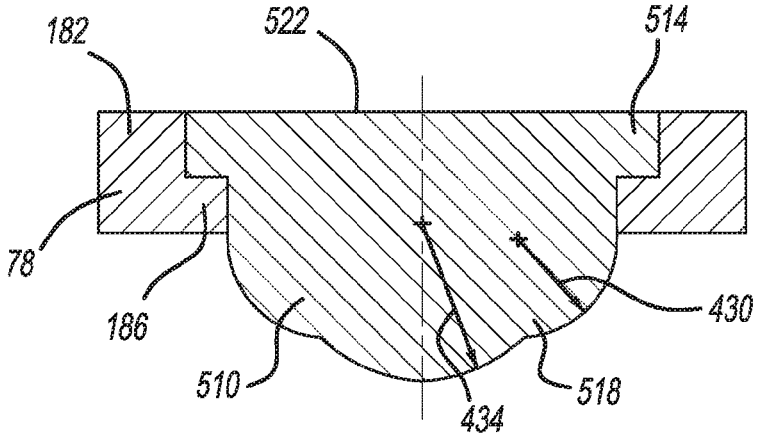

FIG - 6
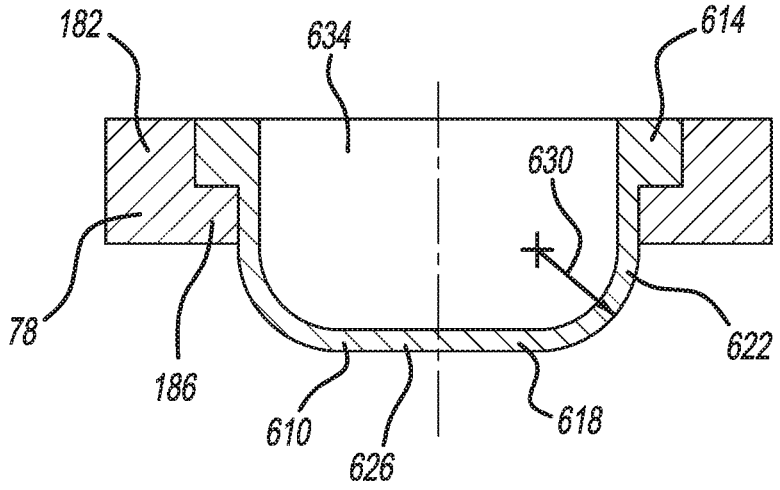
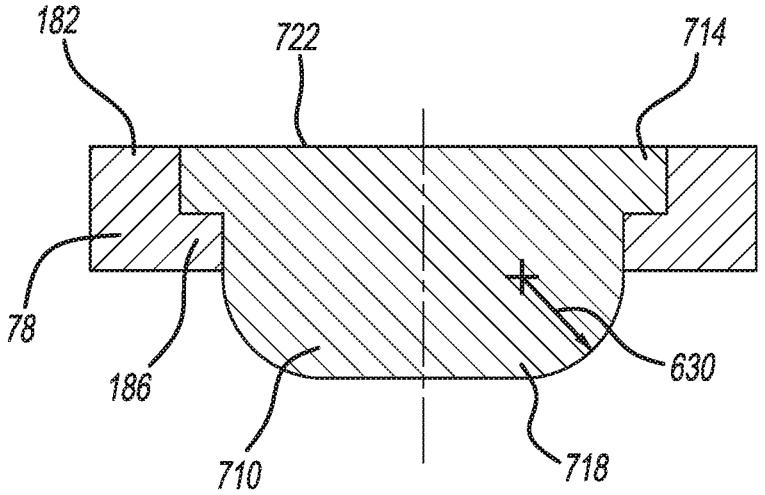
FIG - 7

LASER IGNITION DEVICE

FIELD

The present disclosure relates to a laser ignition device for an internal combustion engine.

BACKGROUND

This section provides background information related to the present disclosure which is not necessarily prior art.

Internal combustion engines ("ICEs") typically include a combustion chamber, an intake and exhaust port, a compression device, a fuel delivery system, and an ignition device. ICEs typically place the ignition device into constant contact with the combustible mixture of air and fuel and control the ignition of that mixture by intermittent activation of the ignition device. For example, intermittent operation of a laser ignition device can produce a plasma flame kernel within the combustion chamber. However, since the laser ignition device is exposed to the high ranges of pressures, temperatures, and chemical mixtures that exist in the combustion chamber during the entire engine cycle, buildup of soot on the laser ignition device can result in inconsistent combustion and loss of fuel economy and power.

SUMMARY

This section provides a general summary of the disclosure, and is not a comprehensive disclosure of its full scope or all of its features.

The present teachings are directed to a laser ignition device for an internal combustion engine ("ICE"). The laser ignition device includes a curved lens configured to inhibit buildup of combustion bi-products on the laser ignition device.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 3 is a sectional view of a protective window of a second construction;

FIG. 4 is a sectional view of a protective window of a third construction;

FIG. 5 is a sectional view of a protective window of a fourth construction;

FIG. 6 is a sectional view of a protective window of a fifth construction; and FIG. 7 is a sectional view of a protective window of a sixth construction.

Corresponding reference numerals indicate corresponding parts throughout the several views of the drawings.

DETAILED DESCRIPTION

Example embodiments will now be described more fully with reference to the accompanying drawings.

The present teachings are directed toward an ignition device that uses focused laser light to ignite a combustible air-fuel mixture within a combustion chamber of an internal combustion engine. The ignition device includes a generally rounded protective window, through which the laser light passes through immediately before entering the combustion chamber. The shape of the protective window can inhibit buildup of soot and other bi-products of combustion that could otherwise scatter or block the laser light.

Figure 1:
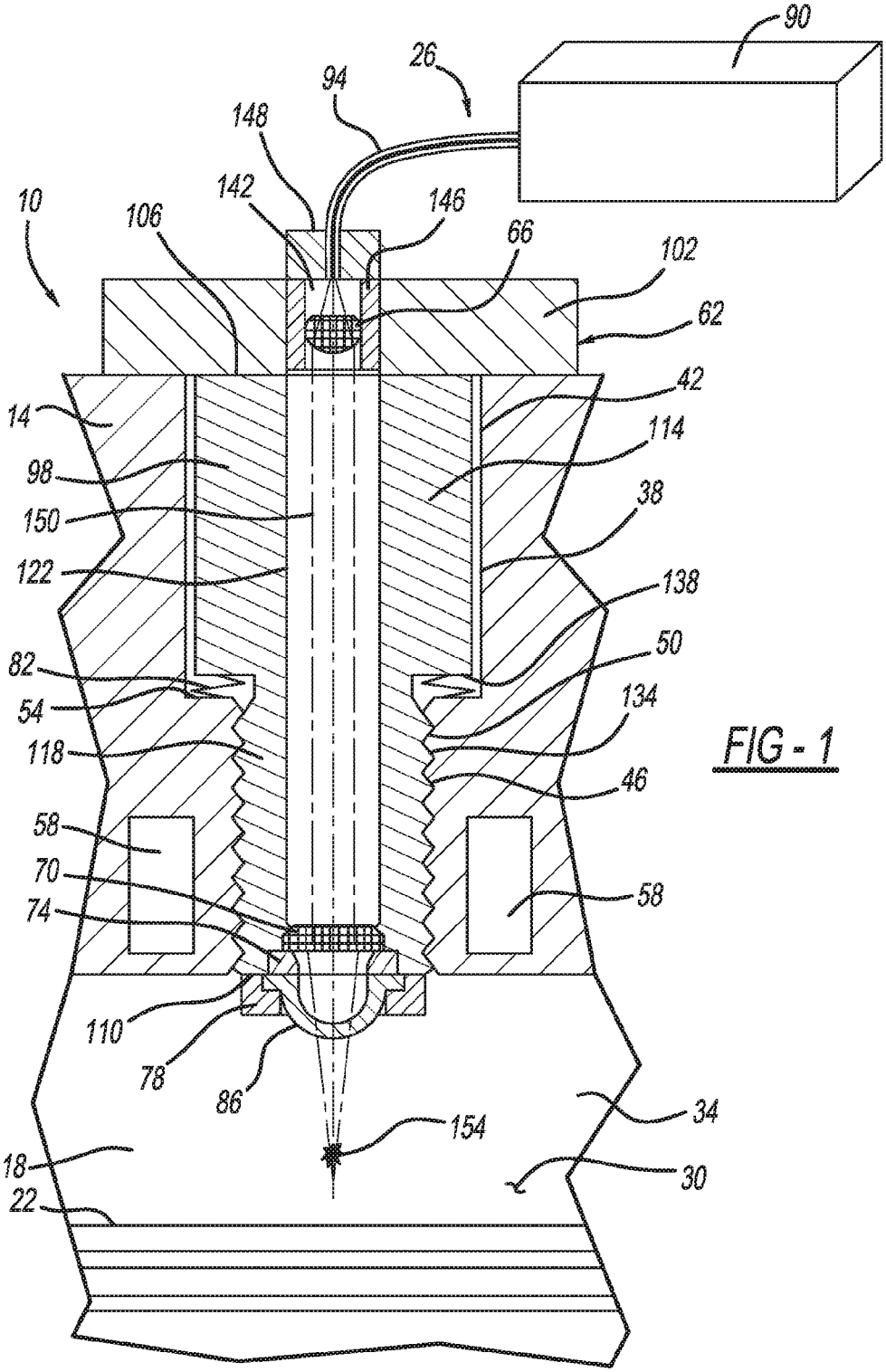
FIG. 1 is a schematic sectional view of a portion of an internal combustion engine including a laser ignition device according to the present teachings.

With reference to FIG. 1, a portion of an internal combustion engine 10 is illustrated. The internal combustion engine 10 can have an engine head 14, an engine block 18, a compression device 22, and an ignition device 26. The engine block 18 can define a cylinder 30. The compression device 22 can be a piston and can be slidably received in the cylinder 30. The engine head 14, engine block 18, and compression device 22 can define a combustion chamber 34. While only one cylinder 30 is illustrated, it is understood that the engine 10 can have any number of cylinders 30 and compression devices 22, in any number of orientations or configurations, such as a gasoline engine, or a natural gas engine for example. While the engine 10 is illustrated and described as a piston-cylinder engine, it is understood that the ignition device 26 can be used with other types of engines that compress an air-fuel mixture in a combustion chamber, such as rotary or Wankel engines for example.

The engine head 14 can be formed of a material that is thermally conductive, such as aluminum, steel, or a metallic alloy for example. The engine head 14 can define a plug bore 38 that extends through the engine head 14. In the example provided, the plug bore 38 can have a first bore section 42 and a second bore section 46 coaxial to the first bore section 42. The second bore section 46 can be located proximate to the combustion chamber 34 and the first bore section 42 can be located distal to the combustion chamber 34. The second bore section 46 can have a plurality of internal threads 50 that can have an outermost diameter that can be less than an outermost diameter of the first bore section 42, such that the first and second bore sections 42, 46 form a step 54.

The engine head 14 can define a cooling conduit 58. The cooling conduit 58 can be configured to allow engine coolant fluid to flow through the engine head 14 proximate to the plug bore 38. The cooling conduit 58 can form a "cooling jacket" that can surround the plug bore 38 to provide cooling on all sides of the plug bore 38. In the example provided, the cooling conduit 58 surrounds the second bore section 46 of the plug bore 38. The engine coolant can absorb heat from the engine head 14 and release the heat away from the engine 10 at a heat exchanger (not shown), such as a radiator for example, in order to cool the engine head 14 and ignition device 26.

The ignition device 26 can include a housing 62, a first lens 66, a second lens 70, a spacer 74, a retainer ring 78, a gasket 82, a protective window 86, and a laser generator 90. The laser generator 90 can be a pulse laser configured to selectively emit pulses of laser light. In the example provided, the laser generator 90 is separate from the housing 62 and is coupled to the housing 62 by an optical fiber 94 that is configured to transmit the pulses of laser light from the laser generator 90 to the housing 62, though other configurations can be used. In an alternative configuration, not specifically shown, the laser generator 90 can be fixedly coupled to the housing 62 and configured to directly emit the laser light into the housing 62.

The housing 62 can include a main body 98 and a cover plate 102. The main body 98 can be generally cylindrical having a first end 106 and a second end 110 that is axially opposite of the first end 106. The main body 98 can have a first body portion 114 proximate to the first end 106 and a second body portion 118 that is proximate to the second end 110 and is coaxial with the first body portion 114. In the example provided, the first and second body portions 114, 118 are unitarily formed, though other configurations can be used such that the first and second body portions 114, 118 can be fixedly coupled to each other. The first and second body portions 114, 118 can define a central bore 122 that extends through the main body 98 and is open at the second end 110. In the example provided, the central bore 122 is also open at the first end 106.

Figure 2:
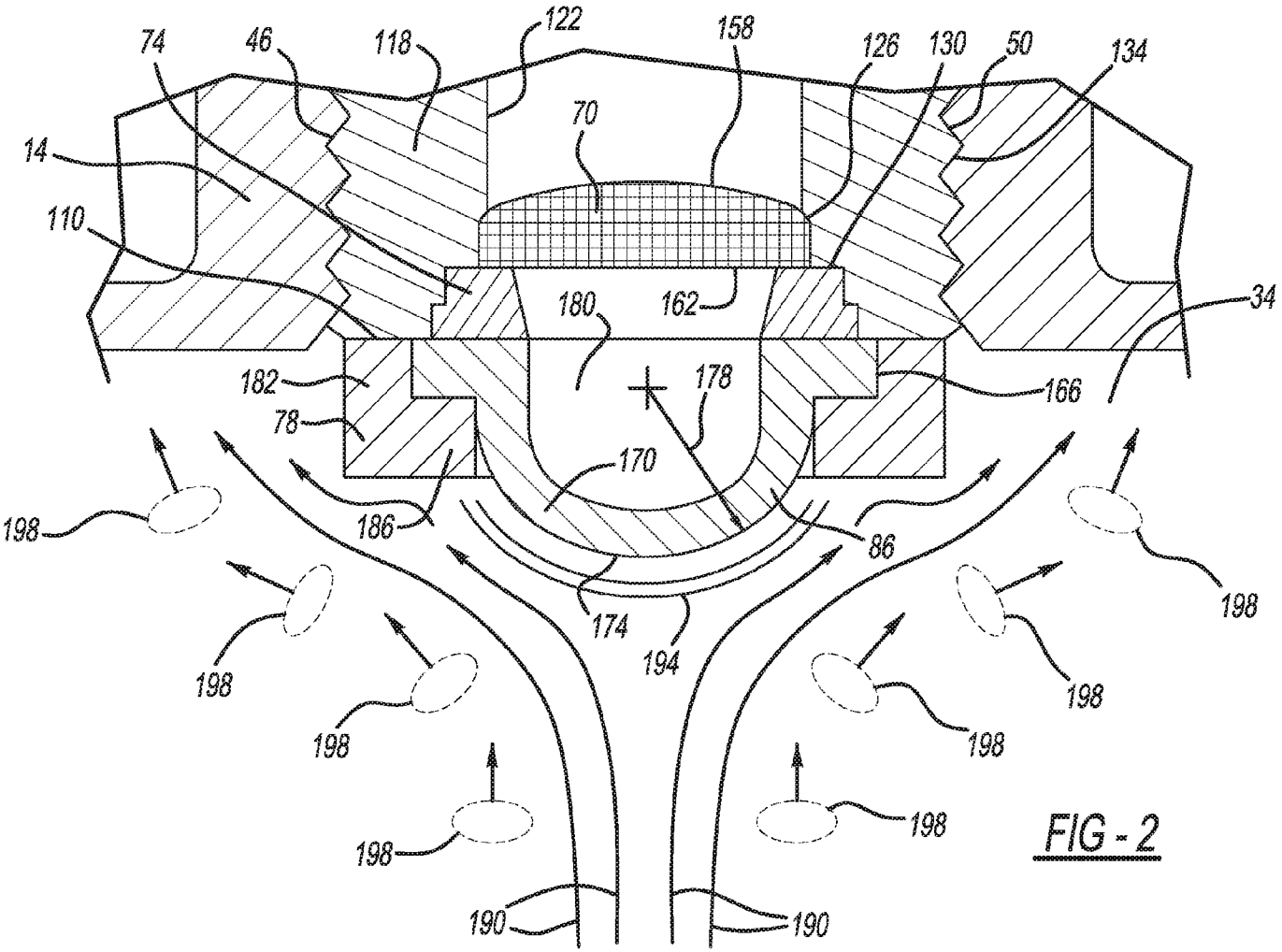
FIG. 2 is a close-up view of a portion of the laser ignition device of FIG. 1, illustrating a protective window of a first construction.

With additional reference to the example shown in FIG. 2, the central bore 122 can widen slightly to define a lens seat 126 proximate to the second end 110. The central bore 122 can widen again between the lens seat 126 and the second end 110 to define a spacer seat 130.

With renewed attention to FIG. 1, the second body portion 118 can have a plurality of external threads 134 configured to mate with the internal threads 50 of the plug bore 38. The first body portion 114 can be disposed within the first bore section 42 when the external threads 134 are threadably engaged with the internal threads 50. In the example provided, the first body portion 114 can have an outermost diameter that is greater than an outermost diameter of the second body portion 118, such that the first body portion 114 defines a step 138 proximate to the second body portion 118 that can oppose the step 54 of the plug bore 38.

The gasket 82 can be an annular shape disposed about the second body portion 118 and disposed axially between the steps 54 and 138. The gasket 82 can be any suitable type of gasket capable of sustaining high temperatures and configured to form a seal between the steps 54 and 138. In the example provided, the gasket 82 is a metal crush ring that compresses between the steps 54 and 138 when the housing 62 is threaded into the plug bore 38, though other configurations can be used.

The cover plate 102 can be coupled to the first body portion 114 and can be coupled to the engine head 14. In the example provided, the cover plate 102 covers the plug bore 38. The cover plate 102 can define a central cavity 142 that can be coaxial with the central bore 122. In the example provided, the first lens 66 can be located within the central cavity 142 and can be fixedly held in place by a lens retainer 146 that is fixedly coupled to the cover plate 102. The optical fiber 94 can be coupled to the cover plate 102 and configured to emit laser light into the central cavity 142 and directed through the first lens 66. In the example provided, the optical fiber 94 is received through an optical fiber holder 148 that connects the optical fiber 94 to the cover plate 102 and holds the optical fiber 94 to emit the laser light into the central cavity 142. In an alternative construction, not specifically shown, the first lens 66 can be within the central bore 122 and the optical fiber 94 can emit light directed through the first lens 66 within the central bore 122.

The first lens 66 can be configured to cause the light particles or rays received from the optical fiber 94 to travel through the central bore 122 to the second lens 70. In the example provided, the first lens 66 is a collimate lens configured to align the light particles or rays to exit the first lens 66 and travel parallel to each other and axially through the central bore 122 as indicated by dashed lines 150, though other configurations can be used.

With additional reference to FIG. 2, the second lens 70 can be located within the second body portion 118 proximate to the second end 110. In the example provided, the second lens 70 can have an outermost diameter that is configured to be received in the central bore 122 from the second end 110. The second lens 70 can abut the lens seat 126 to prevent the second lens 70 from moving axially toward the first end 106 past the lens seat 126.

As best shown in FIG. 1, the second lens 70 can be configured to receive the light particles or rays traveling through the central bore 122 from the first lens 66, and to focus the light particles or rays such that they are concentrated at a focal point 154 within the combustion chamber 34. The focal point 154 can be the point within the combustion chamber 34 where the light particles or rays converge to the greatest intensity and can ignite an air-fuel mixture within the combustion chamber 34. It is understood that the exact focal point of the second lens 70, by itself, can be located at a different location than the focal point 154, due to refraction of the light particles or rays as they pass through the protective window 86, as discussed below. The exact focal point of the second lens 70 can be tuned to account for any refraction or other changes experienced by the light particles or rays through the protective window 86, to ensure the light particles or rays are concentrated at the desired focal point 154 within the combustion chamber 34. In the example provided, the second lens 70 has a first side 158 (FIG. 2) that is convex and a second side 162 (FIG. 2) that is flat, though other configurations can be used to focus the light particles or rays at the focal point 154.

As best shown in FIG. 2, the spacer 74 can be an annular shape that can be coaxial with the central bore 122 and have an outermost diameter such that the spacer 74 can be received in the central bore 122 from the second end 110. The spacer 74 can have an inner diameter, such that the spacer 74 can abut the spacer seat 130 to prevent the spacer 74 from moving axially toward the first end 106 past the spacer seat 130. In the example provided, the spacer has an inner diameter that is less than the outermost diameter of the second lens 70, such that the spacer 74 can abut the second lens 70 to prevent the second lens 70 from moving axially away from the lens seat 126 toward the second end 110. In the example provided, the spacer 74 is a metal material, though other configurations can be used.

The protective window 86 can have a base portion 166 and a tip portion 170. The base portion 166 can have an outermost diameter that is greater than an outermost diameter of the tip portion 170. The base portion 166 can be coaxial with the central bore 122. In the example provided, the outermost diameter of the base portion 166 is greater than the central bore 122, such that the base portion 166 abuts the second end 110 of the main body 98. In the example provided, the base portion 166 is a generally annular shape having an inner diameter that is less than the outermost diameter of the spacer 74, such that the base portion 166 can radially overlap and abut the spacer 74 to prevent the spacer 74 from moving axially out of the central bore 122. The protective window 86 can be formed of any suitable material that can permit the light particles or rays to pass through the protective window 86 into the combustion chamber 34 and sustain high heat and pressures of combustion.

The tip portion 170 can have a generally rounded or dome shape that can extend axially into the combustion chamber 34. An outer surface 174 of the tip portion 170, which faces into the combustion chamber 34, can be smooth. In the example provided, the outer surface 174 has a single, constant radius of curvature 178 across its entire surface, though other configurations can be used. In the example provided, the protective window 86 is hollow, such that the base and tip portions 166, 170 cooperate to define a dome shaped inner cavity 180 that is open toward the central bore 122, though other configurations can be used. In the example provided, the inner cavity 180 has a radius of curvature less than that of the outer surface 174, though other configurations can be used. The outer surface 174 can be a surface of the ignition device 26 that is axially furthest from the second end of the housing and extends axially furthest into the combustion chamber 34.

The retainer ring 78 can be a generally annular shaped body that can be coaxial with the central bore 122. The retainer ring 78 can have a proximate portion 182 and a distal portion 186. The proximate portion 182 can be fixedly mounted to the second end 110 of the main body 98. In the example provided, the proximate portion 182 is welded (e.g., laser welded) to the second end 110, though other configurations can be used, such as fasteners for example.

The base portion 166 of the protective window 86 can be received in the proximate portion 182 of the retainer ring 78, such that the proximate portion 182 is radially outward of the base portion 166. The distal portion 186 can be fixedly coupled to the proximate portion 182 opposite the second end 110. The distal portion 186 can extend radially inward from the proximate portion 182 such that the distal portion 186 can overlap with and abut the base portion 166 to form a seal with the base portion 166 and to prevent the protective window 86 from moving axially away from the second end 110. Thus, the retainer ring 78 can hold the protective window 86, the spacer 74 and the second lens 70 in place. The distal portion 186 can have an innermost diameter such that the tip portion 170 of the protective window 86 extends axially through the distal portion 186. The outer surface 174 of the tip portion 170 can extend axially into the combustion chamber 34 further than the retainer ring 78.

In operation, after the ignition device 26 causes the ignition of the air-fuel mixture within the combustion chamber 34, the combustion gases expand outward from the focal point 154 (FIG. 1). At least some of the combustion gases flow toward the ignition device 26, as schematically illustrated by arrows 190. The combustion gases 190 form a laminar boundary layer 194 about the outer surface 174 of the tip portion 170 of the protective window 86, as they flow over the tip portion 170. The curved or dome shape of the tip portion 170 generally directs the combustion gases 190 radially outward and away from the ignition device 26. During combustion of the air-fuel mixture, combustion bi-products or deposits 198 (e.g., oil, soot, particulates) can flow toward the ignition device 26 with the combustion gases 190.

The laminar boundary layer 194 can inhibit the deposits 198 from reaching the protective window 86, such that the deposits 198 can flow with the combustion gases 190 outward and away from the ignition device 26. The curved outer surface 174 of the protective window 86 can also inhibit the deposits 198 from building up on the protective window 86. The curved shape promotes flow separation of the combustion gases 190 to flow radially outward across the outer surface 174 to push deposits 198 radially outward and away from the radially inner area of the protective window 86 where the laser light particles or rays pass through the protective window 86.

With additional reference to FIG. 3, a protective window 310 of a second construction is illustrated with the retainer ring 78. The protective window 310 can be similar to the protective window 86 (FIGS. 1 and 2), except as otherwise shown or described herein. The protective window 310 can have a base portion 314 and a tip portion 318. The base portion 314 and the tip portion 318 can be similar to the base portion 166 (FIGS. 1 and 2) and tip portion 170 (FIGS. 1 and 2) except that the base portion 314 and tip portion 318 can be a solid body and not define the dome shaped cavity 180 (FIGS. 1 and 2). In the example shown, a side 322 of the base portion 314 that is proximate to the second end 110 is flat, though other configurations can be used. In one alternative configuration, not particularly shown, the side 322 can be convex.

With additional reference to FIG. 4, a protective window 410 of a third construction is illustrated with the retainer ring 78. The protective window 410 can be similar to the protective window 86 (FIGS. 1 and 2), except as otherwise shown or described herein. The protective window 410 can have a base portion 414 and a tip portion 418. The base portion 414 can be similar to the base portion 166 (FIGS. 1 and 2). The tip portion 418 can be similar to the tip portion 170 (FIGS. 1 and 2), except that the tip portion 418 can have more than one radius of curvature.

In the example provided, the tip portion 418 has a first region 422 that extends from the base portion 414 to a second region 426. The first region 422 can have a radius of curvature 430 that can extend annularly about a central axis of the protective window 410 and is radially outward of the second region 426. The second region 426 can have a generally dome shape centered on the central axis. The dome shape of the second region 426 can have a second radius of curvature 434 that can be different from the radius of curvature 430 of the first region 422. In the example provided, the radius of curvature 430 of the first region 422 is less than the second radius of curvature 434 of the second region 426, though other configurations can be used. In the example provided, the protective window 410 is generally hollow, such that the base portion 414 and the tip portion 418 define an inner cavity 438 that is open toward the central bore 122 (FIGS. 1 and 2).

With additional reference to FIG. 5, a protective window 510 of a fourth construction is illustrated with the retainer ring 78. The protective window 510 can be similar to the protective window 410 (FIG. 4), except as otherwise shown or described herein. The protective window 510 can have a base portion 514 and a tip portion 518. The base portion 514 and the tip portion 518 can be similar to the base portion 414 (FIG. 4) and tip portion 418 (FIG. 4) except that the base portion 514 and tip portion 518 can be a solid body and not define the inner cavity 438 (FIG. 4). In the example shown, a side 522 of the base portion 514 that is proximate to the second end 110 is flat, though other configurations can be used. In one alternative configuration, not particularly shown, the side 522 can be convex.

With additional reference to FIG. 6, a protective window 610 of a third construction is illustrated with the retainer ring 78. The protective window 610 can be similar to the protective window 86 (FIGS. 1 and 2), except as otherwise shown or described herein. The protective window 610 can have a base portion 614 and a tip portion 618. The base portion 614 can be similar to the base portion 166 (FIGS. 1 and 2). The tip portion 618 can be similar to the tip portion 170 (FIGS. 1 and 2), except that the tip portion 618 can have a first, curved region 622 that extends from the base portion 614 to a second, flat region 626. The curved region 622 can have a radius of curvature 630 that can extend annularly about a central axis of the protective window 610 and radially outward of the flat region 626. The curved region 622 can smoothly transition from the base portion 614 into the curved region 622 and from the curved region 622 into the flat region 626. The flat region 626 can be generally perpendicular to the central axis of the protective window 610.

In the example provided, the light particles or rays from the second lens 70 can pass through the flat region 626, but do not pass through the curved region 622, though other configurations can be used. In the example provided, the protective window 610 is generally hollow, such that the base portion 614 and the tip portion 618 define an inner cavity 634 that is open toward the central bore 122 (FIGS. 1 and 2).

With additional reference to FIG. 7, a protective window 710 of a sixth construction is illustrated with the retainer ring 78. The protective window 710 can be similar to the protective window 610 (FIG. 6), except as otherwise shown or described herein. The protective window 710 can have a base portion 714 and a tip portion 718. The base portion 714 and the tip portion 718 can be similar to the base portion 614 (FIG. 6) and tip portion 618 (FIG. 6) except that the base portion 714 and tip portion 718 can be a solid body and not define the inner cavity 634 (FIG. 6). In the example shown, a side 722 of the base portion 714 that is proximate to the second end 110 is flat, though other configurations can be used. In one alternative configuration, not particularly shown, the side 722 can be convex.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An ignition device for an internal combustion engine, the ignition device comprising: a laser generator configured to emit a pulse of laser light; a housing configured to be coupled to the internal combustion engine, the housing having a first end and a second end, the second end being proximate to a combustion chamber of the internal combustion engine and defining an aperture through which the laser light is permitted to exit the housing into the combustion chamber; a window coupled to the second end of the housing and covering the aperture, the window being configured to permit the laser light to pass through the window and into the combustion chamber, the window having a rounded outer surface; a focusing lens disposed within the housing between the first and second ends, and configured to focus the laser light to a focal point outside of the housing and within the combustion chamber; and wherein the focusing lens is directly on a spacer, and the spacer is directly on the window.

2. The ignition device of claim 1, further comprising a collimate lens disposed between the laser generator and the focusing lens, the collimate lens directing the laser light to the focusing lens.

3. The ignition device of claim 1, wherein the outer surface of the window has a single radius of curvature.

4. The ignition device of claim 1, wherein the window defines a cavity open toward the aperture.

5. The ignition device of claim 1, wherein the outer surface of the window has more than one radius of curvature.

6. The ignition device of claim 1, wherein the window defines a dome centered about the aperture.

7. The ignition device of claim 6, wherein the window defines an intermediate surface that curves from the dome toward the housing.

8. The ignition device of claim 1, wherein the outer surface is convex and faces away from the housing.

9. The ignition device of claim 1, wherein the outer surface includes a flat portion through which the laser light passes, and a curved portion that is radially outward of the flat portion and smoothly transitions from the flat portion toward the housing.

10. An ignition device for an internal combustion engine, the ignition device comprising: a laser generator configured to emit a pulse of laser light; a housing configured to be coupled to the internal combustion engine, the housing having a first end and a second end, the second end being proximate to a combustion chamber of the internal combustion engine and defining an aperture through which the laser light is permitted to exit the housing into the combustion chamber; a focusing lens disposed within the housing between the first and second ends and configured to focus the laser light to a focal point outside of the housing and within the combustion chamber; and a window coupled to the second end of the housing and protruding axially outward from the housing, the window being configured to permit laser light received from the focusing lens to pass through the window and into the combustion chamber, the window having a convex surface that faces away from the housing; and wherein the focusing lens is directly on a spacer, and the spacer is directly on the window.

11. The ignition device of claim 10, further comprising a collimate lens disposed between the laser generator and the focusing lens, the collimate lens directing the laser light to the focusing lens.

12. The ignition device of claim 10, wherein the convex surface of the window has a single radius of curvature.

13. The ignition device of claim 10, wherein the window defines a cavity open toward the aperture.

14. The ignition device of claim 10, wherein the convex surface of the window has more than one radius of curvature.

15. The ignition device of claim 10, wherein the window forms a dome centered about the aperture.

16. The ignition device of claim 10, wherein the window includes a flat surface through which the laser light passes, and the convex surface is radially outward of the flat surface and smoothly transitions from the flat surface toward the housing.

17. An ignition device for an internal combustion engine, the ignition device comprising: a laser generator configured to emit a pulse of laser light; a housing configured to be coupled to the internal combustion engine, the housing having a first end and a second end, the second end being proximate to a combustion chamber of the internal combustion engine and defining an aperture through which the laser light is permitted to exit the housing into the combustion chamber; a focusing lens disposed within the housing between the first and second ends and configured to focus the laser light to a focal point outside of the housing and within the combustion chamber; and a window that covers the aperture and defines an outer surface of the ignition device that is axially furthest from the second end of the housing, the outer surface having a first portion that is convex facing away from the housing, the window being formed of a material that permits laser light to travel from the focusing lens through the window and into the combustion chamber; and wherein the focusing lens is directly on a spacer, and the spacer is directly on the window.

18. The ignition device of claim 17, wherein the outer surface has a dome shape centered about the aperture.

19. The ignition device of claim 17, wherein the first portion has a radius of curvature that has a center that is offset from a central axis of the housing.

* * * * *